US011761443B2

(12) United States Patent
Ota et al.

(10) Patent No.: US 11,761,443 B2
(45) Date of Patent: Sep. 19, 2023

(54) COMPRESSOR AND MONITORING SYSTEM

(71) Applicant: Hitachi Industrial Equipment Systems Co., Ltd., Tokyo (JP)

(72) Inventors: Yuya Ota, Tokyo (JP); Tomoo Suzuki, Tokyo (JP); Yoshio Anzai, Tokyo (JP)

(73) Assignee: Hitachi Industrial Equipment Systems Co., Ltd., Tokyo (JP)

( * ) Notice: Subject to any disclaimer, the term of this patent is extended or adjusted under 35 U.S.C. 154(b) by 291 days.

(21) Appl. No.: 17/257,721

(22) PCT Filed: Jun. 4, 2019

(86) PCT No.: PCT/JP2019/022181
§ 371 (c)(1),
(2) Date: Jan. 4, 2021

(87) PCT Pub. No.: WO2020/012829
PCT Pub. Date: Jan. 16, 2020

(65) Prior Publication Data

US 2021/0293239 A1 Sep. 23, 2021

(30) Foreign Application Priority Data

Jul. 10, 2018 (JP) ..... 2018-130429

(51) Int. Cl.
*F04C 28/28* (2006.01)
*F04C 23/00* (2006.01)
(Continued)

(52) U.S. Cl.
CPC ..... *F04C 28/28* (2013.01); *F04C 23/001* (2013.01); *F04C 28/08* (2013.01);
(Continued)

(58) Field of Classification Search
CPC ..... F04C 28/28; F04C 23/001; F04C 28/08; F04C 29/0092; F04C 29/04; F04C 18/16;
(Continued)

(56) References Cited

U.S. PATENT DOCUMENTS

2003/0055534 A1* 3/2003 Saito ..... G05B 23/0283 705/1.1
2012/0021321 A1* 1/2012 Yasuda ..... H01M 8/04768 429/442
(Continued)

FOREIGN PATENT DOCUMENTS

JP 2001-153080 A 6/2001
JP 2003-91313 A 3/2003
JP 2018-13319 A 1/2018

OTHER PUBLICATIONS

International Search Report (PCT/ISA/210) issued in PCT Application No. PCT/JP2019/022181 dated Sep. 3, 2019 with English translation (two (2) pages).
(Continued)

*Primary Examiner* — Connor J Tremarche
(74) *Attorney, Agent, or Firm* — Crowell & Moring LLP

(57) ABSTRACT

Provided are a compressor and a monitoring system that can specify a cause of an anomaly of a sensed value of a sensor. A compressor (1) includes: a temperature sensor (11A) that senses a temperature of a compressed air on a discharge side of a low-pressure-stage compressor body (3) and on an upstream side of an intercooler (5); a pressure sensor (12A) that senses a pressure of the compressed air on the discharge side of the low-pressure-stage compressor body (3); a temperature sensor (11B) that senses a temperature of the compressed air on an intake side of a high-pressure-stage compressor body (6) and on a downstream side of the intercooler (5); a temperature sensor (11C) that senses a temperature of the compressed air on a discharge side of the
(Continued)

high-pressure-stage compressor body (6); a controller (8) that decides whether or not an anomaly has occurred in sensed values of the sensors (11A), (11B), (11C), and (12A), and estimates a cause of the anomaly; and a display device (9) that displays the cause of the anomaly estimated by the controller (8).

13 Claims, 5 Drawing Sheets

(51) Int. Cl.

| | |
|---|---|
| ***F04C 28/08*** | (2006.01) |
| ***F04C 29/00*** | (2006.01) |
| ***F04C 29/04*** | (2006.01) |
| *F04C 18/16* | (2006.01) |

(52) U.S. Cl.
CPC ..... *F04C 29/0092* (2013.01); *F04C 29/04* (2013.01); *F04C 18/16* (2013.01); *F04C 2210/221* (2013.01); *F04C 2240/81* (2013.01); *F04C 2270/0525* (2013.01); *F04C 2270/18* (2013.01); *F04C 2270/19* (2013.01); *F04C 2270/80* (2013.01); *F04C 2270/90* (2013.01)

(58) Field of Classification Search
CPC ..... F04C 2240/81; F04C 2270/0525; F04C 2270/18; F04C 2270/19; F04C 227/80; F04C 2270/90
See application file for complete search history.

(56) References Cited

U.S. PATENT DOCUMENTS

| | | | | |
|---|---|---|---|---|
| 2016/0238284 | A1* | 8/2016 | Krystad | F25B 49/022 |
| 2017/0146001 | A1* | 5/2017 | Nagura | F04B 35/04 |
| 2018/0223847 | A1* | 8/2018 | Fujiwara | F04B 39/16 |

OTHER PUBLICATIONS

Japanese-language Written Opinion (PCT/ISA/237) issued in PCT Application No. PCT/JP2019/022181 dated Sep. 3, 2019 (five (5) pages).

International Preliminary Report on Patentability (PCT/IB/338 & PCT/IB/373) issued in PCT Application No. JP2019/022181 dated Jan. 21, 2021, including English translation of document C2 (Japanese-language Written Opinion (PCT/ISA/237) filed on Jan. 4, 2021) (nine (9) pages).

* cited by examiner

FIG. 2

| T1 | P1 | T2 | T3 | P2 | CAUSE OF ANOMALY |
|---|---|---|---|---|---|
| NORMAL | LOW | LOW | HIGH | – | AIR LEAKAGE ON UPSTREAM SIDE OF INTERCOOLER, OR CLOGGING OF INTAKE AIR FILTER |
| | | NORMAL | | | AIR LEAKAGE ON INSIDE OR ON DOWNSTREAM SIDE OF INTERCOOLER |
| | NORMAL | | NORMAL | LOW | AIR LEAKAGE ON DOWNSTREAM SIDE OF HIGH-PRESSURE-STAGE COMPRESSOR |
| | HIGH | HIGH | HIGH | – | INCREASE IN COOLANT TEMPERATURE, DETERIORATION OF COOLING PERFORMANCE OF INTERCOOLER DUE TO DIRT, INSUFFICIENT COOLANT, OR FREEZING OF COOLANT |
| | LOW | LOW | LOW | – | DECREASE IN COOLANT TEMPERATURE |
| | HIGH | NORMAL | | – | LOWERING OF REVOLUTION SPEED OF HIGH-PRESSURE-STAGE COMPRESSOR |

COMPRESSOR AND MONITORING SYSTEM

TECHNICAL FIELD

The present invention relates to a compressor including a low-pressure-stage compressor body, an intercooler and a high-pressure-stage compressor body, and to a monitoring system.

BACKGROUND ART

There has been used a multi-stage type compressor including: a low-pressure-stage compressor body that compresses air; an intercooler that cools the compressed air discharged from the low-pressure-stage compressor body; and a high-pressure-stage compressor body that further compresses the compressed air cooled by the intercooler. Patent Document 1 discloses one example of multi-stage type compressors.

PRIOR ART DOCUMENT

Patent Document

Patent Document 1: JP-2001-153080-A

SUMMARY OF THE INVENTION

Problem to be Solved by the Invention

A multi-stage type compressor includes, for example: a temperature sensor that senses the temperature of compressed air on the discharge side of a low-pressure-stage compressor body and on the upstream side of an intercooler; a pressure sensor that senses the pressure of the compressed air on the discharge side of the low-pressure-stage compressor body; a temperature sensor that senses the temperature of the compressed air on the intake side of the high pressure compressor body and on the downstream side of the intercooler; a temperature sensor that senses the temperature of the compressed air on the discharge side of the high-pressure-stage compressor body; a pressure sensor that senses the pressure of the compressed air on the discharge side of the high-pressure-stage compressor body; a controller; and a notification device. The controller decides that an anomaly has occurred when a sensed value of any of the sensors mentioned before is higher than a predetermined normal range, and controls a notification device to perform notification of the anomaly. Thereby, a user of the compressor can know the anomaly of the sensed value of the sensor. However, it has not been easy to specify a cause of an anomaly of a sensed value of a sensor.

The present invention has been made in view of the matters described above, and one of objects of the present invention is to specify a cause of an anomaly of a sensed value of a sensor.

Means for Solving the Problem

In order to solve the problem described above, the configurations described in claims are applied. The present invention includes a plurality of means for solving the problem described above, and one example thereof is a compressor including: a low-pressure-stage compressor body that compresses a gas; an intercooler that uses a cooling medium to cool the compressed gas discharged from the low-pressure-stage compressor body; and a high-pressure-stage compressor body that further compresses the compressed gas having been cooled by the intercooler. The compressor includes: a first temperature sensor that senses a temperature of the compressed gas on a discharge side of the low-pressure-stage compressor body and on an upstream side of the intercooler; a first pressure sensor that senses a pressure of the compressed gas on the discharge side of the low-pressure-stage compressor body; a second temperature sensor that senses a temperature of the compressed gas on an intake side of the high-pressure-stage compressor body and on a downstream side of the intercooler; a third temperature sensor that senses a temperature of the compressed gas on a discharge side of the high-pressure-stage compressor body; a controller that decides whether or not an anomaly has occurred in a sensed temperature of the first temperature sensor, a sensed pressure of the first pressure sensor, a sensed temperature of the second temperature sensor, and a sensed temperature of the third temperature sensor, and estimates a cause of the anomaly; and a notification device that performs a notification of the cause of the anomaly estimated by the controller.

Advantage of the Invention

The present invention makes it possible to specify a cause of an anomaly of a sensed value of a sensor.

Note that problems, configurations and advantages other than those described above are made apparent by the following explanation.

BRIEF DESCRIPTION OF THE DRAWINGS

FIG. 2 is a figure for explaining a method of estimating a cause of an anomaly performed by a controller according to the one embodiment of the present invention.

MODES FOR CARRYING OUT THE INVENTION

A compressor according to one embodiment of the present invention is explained with reference to the drawings.

Figure 1:
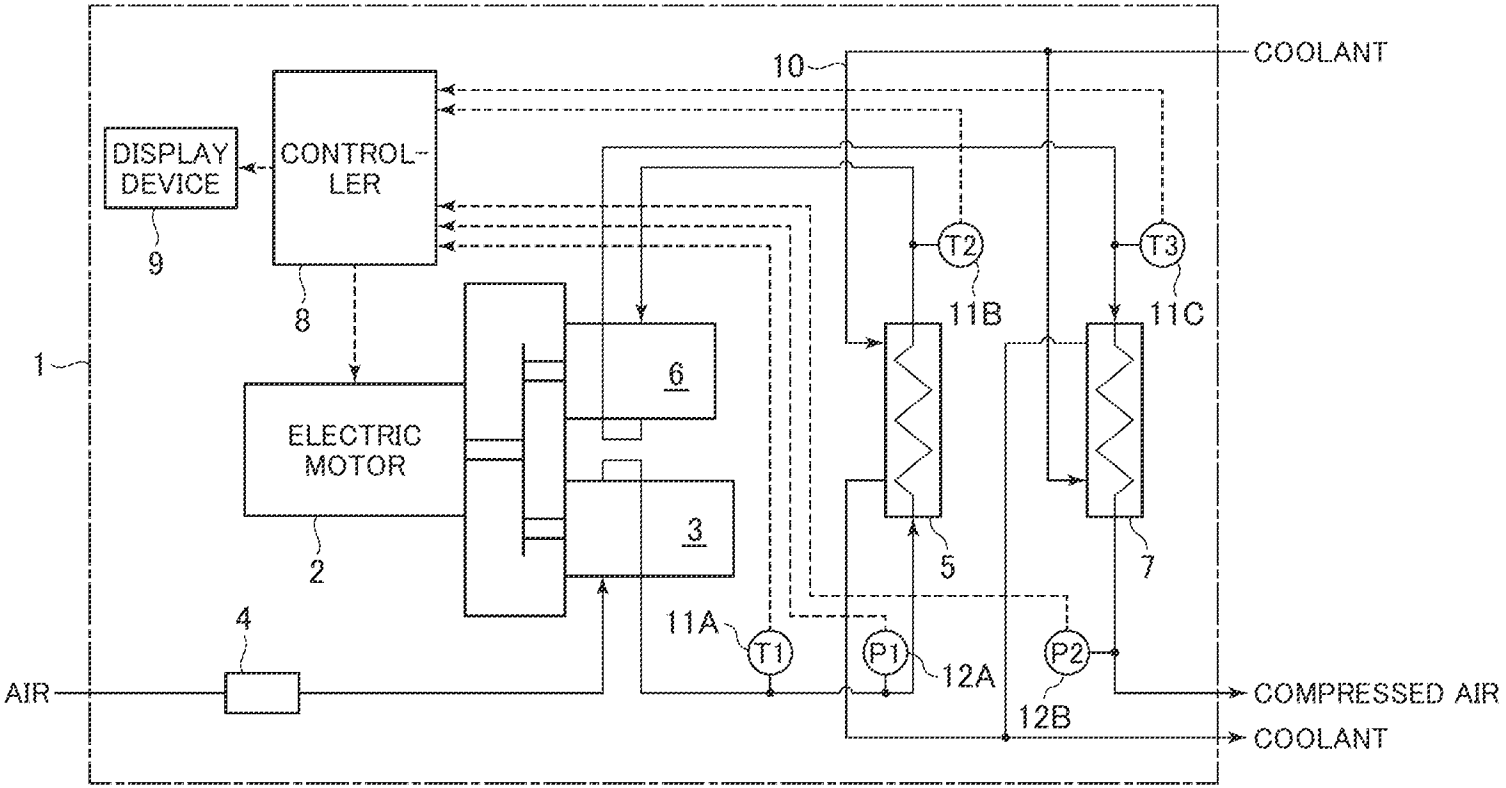
FIG. 1 is a schematic diagram representing a configuration of a compressor according to one embodiment of the present invention.

FIG. 1 is a schematic diagram representing a configuration of a compressor according to the present embodiment.

A compressor 1 according to the present embodiment includes: an electric motor 2; a low-pressure-stage compressor body 3 that is driven by the electric motor 2, takes in air (gas), and compresses the air; an intake air filter 4 that is provided on the intake side of the low-pressure-stage compressor body 3; an intercooler 5 that cools the compressed air (compressed gas) discharged from the low-pressure-stage compressor body 3; a high-pressure-stage compressor body 6 that is driven by the electric motor 2, takes in the compressed air cooled by the intercooler 5, and further compresses the compressed air; an aftercooler 7 that cools the compressed air discharged from the high-pressure-stage compressor body 6; a controller 8; and a display device 9. Note that the compressor 1 may be a package type compressor unit housing the equipment mentioned before.

The low-pressure-stage compressor body 3 includes, for example, a pair of female and male screw rotors, and a casing that houses the screw rotors, and compression chambers are formed in tooth grooves of the screw rotors, although these are not illustrated. The compression chambers move in the axial direction of the rotors along with the rotation of the rotors, and sequentially perform a process of taking in air, a process of compressing the air, and a process of discharging the air. The configuration of the high-pressure-stage compressor body 6 is also almost the same as that of the low-pressure-stage compressor body 3.

The intercooler 5 and the aftercooler 7 cool the compressed air by using a coolant (cooling medium) supplied via a coolant line 10. The compressed air cooled by the aftercooler 7 is supplied to user equipment in which the compressed air is used.

The controller 8 has: a calculation control section (e.g. a CPU) that executes calculation processes and control processes on the basis of programs; a storage section (e.g. a ROM and a RAM) that stores the programs and results of the calculation processes; and the like.

A temperature sensor 11A is provided on the discharge side of the low-pressure-stage compressor body 3 and on the upstream side of the intercooler 5, and a temperature T1 (low-pressure-stage discharge temperature) of the compressed air sensed by the temperature sensor 11A is output to the controller 8. A pressure sensor 12A is provided on the discharge side of the low-pressure-stage compressor body 3 (specifically, may be provided on the upstream side of the intercooler 5 as illustrated in the figure, or may be provided on the downstream side of the intercooler 5), and a pressure P1 (low pressure stage) of the compressed air sensed by the pressure sensor 12A is output to the controller 8. A temperature sensor 11B is provided on the intake side of the high-pressure-stage compressor body 6 and on the downstream side of the intercooler 5, and a temperature T2 of the compressed air sensed by the temperature sensor 11B is output to the controller 8.

A temperature sensor 11C is provided on the discharge side of the high-pressure-stage compressor body 6 (specifically, may be provided on the upstream side of the aftercooler 7 as illustrated in the figure, or may be provided on the downstream side of the aftercooler 7), and a temperature T3 of the compressed air sensed by the temperature sensor 11C is output to the controller 8. A pressure sensor 12B is provided on the discharge side of the high-pressure-stage compressor body 6 (specifically, may be provided on the downstream side of the aftercooler 7 as illustrated in the figure, or may be provided on the upstream side of the aftercooler 7), and a pressure P2 of the compressed air sensed by the pressure sensor 12B is output to the controller 8.

The controller 8 controls the electric motor 2 according to operation of a running switch (not illustrated), for example. In addition, the controller 8 decides whether or not an anomaly has occurred in the sensed temperature T1 of the temperature sensor 11A, the sensed pressure P1 of the pressure sensor 12A, the sensed temperature T2 of the temperature sensor 11B, the sensed temperature T3 of the temperature sensor 11C, and the sensed pressure P2 of the pressure sensor 12B, and estimates a cause of the anomaly. Explaining specifically, the controller 8 stores in advance a predetermined normal range that is preset corresponding to the sensed value of each sensor, decides whether or not the sensed value of each sensor is within the predetermined normal range, and, if the sensed value of each sensor is not within the predetermined normal range, decides whether the sensed value is higher or lower than the predetermined normal range. Then, on the basis of results of the decisions, the controller 8 estimates a cause of the anomaly as illustrated in FIG. 2 (specifically, leakage of the compressed air, increase or decrease in coolant temperature, lowering of a revolution speed of the high-pressure-stage compressor body 6, etc.).

Figure 3:
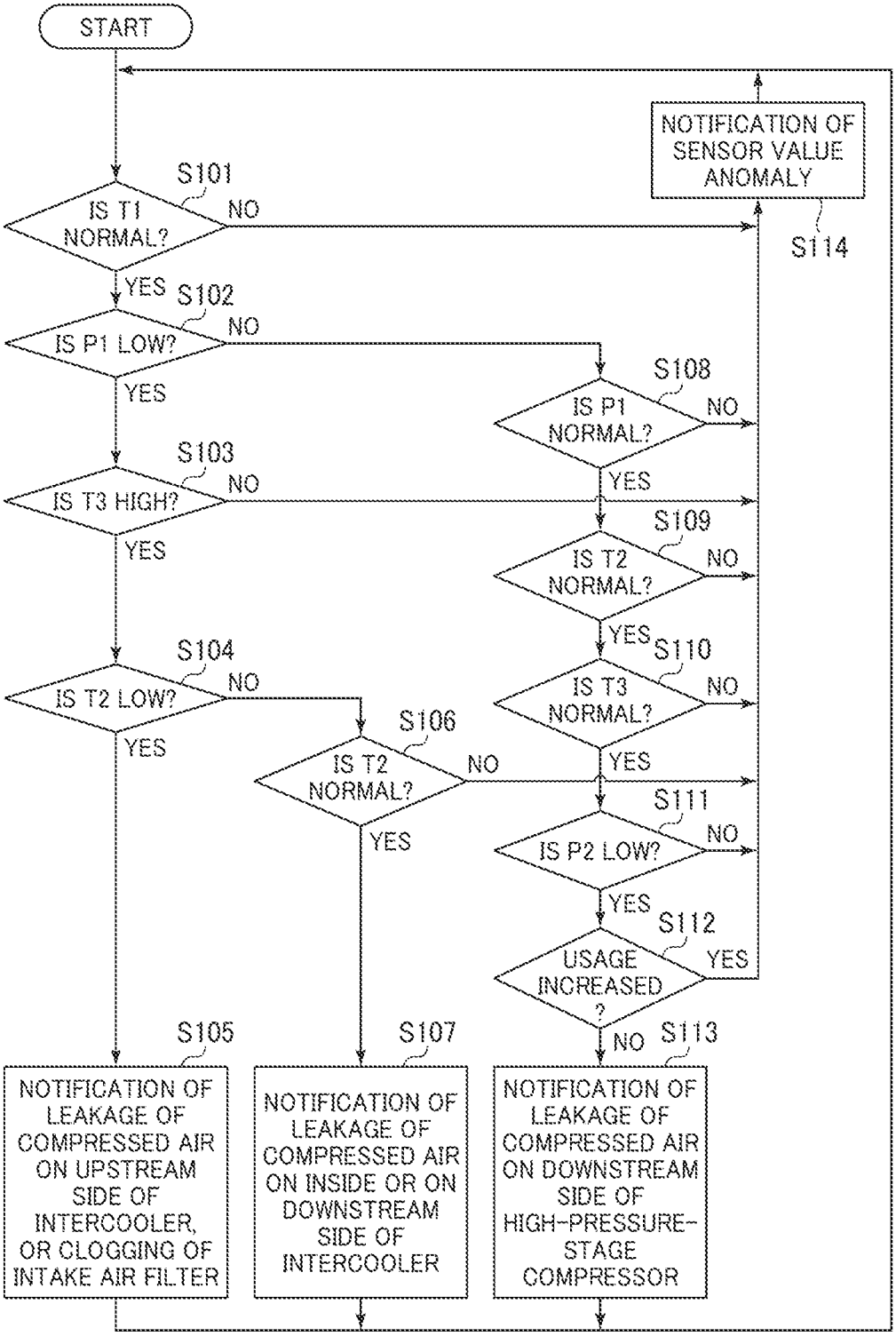
FIG. 3 is a flowchart representing a specific example of an estimating procedure of leakage of compressed air performed by the controller according to the one embodiment of the present invention.

First, an estimating procedure of leakage of the compressed air performed by the controller 8 according to the present embodiment is explained by using FIG. 3. FIG. 3 is a flowchart representing a specific example of the estimating procedure of leakage of the compressed air performed by the controller 8 according to the present embodiment. Note that it is needless to say that, for the controller 8, the order of Steps S101 to S104, S106, and S108 to S112 mentioned below may be changed, or for example the controller 8 may perform estimation in a manner of comparing a combination of decision results about the sensed values of the sensors with the table illustrated in FIG. 2.

The controller 8 decides that the results at Step S101, S102 and S103 are YES and proceeds to Step S104 when the sensed temperature T1 of the temperature sensor 11A is within a predetermined normal range, the sensed pressure P1 of the pressure sensor 12A is lower than a predetermined normal range, and the sensed temperature T3 of the temperature sensor 11C is higher than a predetermined normal range. Further, when the sensed temperature T2 of the temperature sensor 11B is lower than the predetermined normal range, the result of the decision at Step S104 is YES, and the process proceeds to Step S105. At Step S105, the controller 8 estimates, as the cause of the anomaly, leakage of the compressed air on the upstream side of the intercooler 5 or clogging of the intake air filter 4, and outputs, to the display device 9, a command to perform a notification about the probable cause. The display device 9 displays a message, "Leakage of compressed air on upstream side of intercooler, or clogging of intake air filter," for example, in response to the command.

The reason why the controller 8 can estimate, based on the decision results mentioned above, as the cause of the anomaly, leakage of the compressed air on the upstream side of the intercooler 5 or clogging of the intake air filter 4 is explained. When leakage of the compressed air on the upstream side of the intercooler 5 occurs, the volume of air in a line from the low-pressure-stage compressor body 3 to the high-pressure-stage compressor body 6 decreases. Alternatively, when clogging of the intake air filter 4 occurs, the intake air volume of the low-pressure-stage compressor body 3 decreases, and thus the volume of air to be supplied to the line from the low-pressure-stage compressor body 3 to the high-pressure-stage compressor body 6 decreases. Since the volume of the line from the low-pressure-stage compressor body 3 to the high-pressure-stage compressor body 6 is constant, the pressure P1 decreases along with a decrease in air volume if the temperature T1 remains constant. In addition, since the volume of air to be supplied to the intercooler 5 decreases, the intercooler 5 is cooled excessively, and the temperature T2 on the downstream side of the intercooler 5 lowers. Furthermore, along with the decrease in the pressure P1, the compression ratio of the high-pressure-stage compressor body 6 increases, and the temperature T3 increases.

The controller 8 decides that the results at Steps S101, S102, and S103 are YES and proceeds to Step S104 when the sensed temperature T1 of the temperature sensor 11A is within the predetermined normal range, the sensed pressure P1 of the pressure sensor 12A is lower than the predetermined normal range, and the sensed temperature T3 of the temperature sensor 11C is higher than the predetermined normal range. Furthermore, when the sensed temperature T2 of the temperature sensor 11B is within the predetermined normal range, the result of the decision at Step S104 is NO, the process proceeds to Step S106, the result of the decision at Step S106 is YES, and the process proceeds to Step S107. At Step S107, the controller 8 estimates, as the cause of the anomaly, leakage of the compressed air on the inside or on the downstream side of the intercooler 5, and outputs, to the display device 9, a command to perform a notification about the probable cause. The display device 9 displays a message, "Leakage of compressed air on the inside or on downstream side of intercooler," for example, in response to the command.

The reason why the controller 8 can estimate, based on the decision results mentioned above, as the cause of the anomaly, leakage of the compressed air on the inside or on the downstream side of the intercooler 5 is explained. When leakage of the compressed air on the inside or on the downstream side of the intercooler 5 occurs, the volume of air in the line from the low-pressure-stage compressor body 3 to the high-pressure-stage compressor body 6 decreases. Since the volume of the line from the low-pressure-stage compressor body 3 to the high-pressure-stage compressor body 6 is constant, the pressure P1 decreases along with a decrease in air volume if the temperature T1 remains constant. In addition, since the intercooler 5 is cooled normally, the temperature T2 is a normal value. Then, along with the decrease in the pressure P1, the compression ratio of the high-pressure-stage compressor body 6 increases, and the temperature T3 increases.

The controller 8 decides that the result at Step S101 is YES and proceeds to Step S102 when the sensed temperature T1 of the temperature sensor 11A is within the predetermined normal range. Furthermore, when the sensed pressure P1 of the pressure sensor 12A is within the predetermined normal range, the result of the decision at Step S102 is NO, the process proceeds to Step S108, the result of the decision at Step S108 is YES, and the process proceeds to Step S109. Furthermore, when the sensed temperature T2 of the temperature sensor 11B is within the predetermined normal range, the sensed temperature T3 of the temperature sensor 11C is within the predetermined normal range, and the sensed pressure P2 of the pressure sensor 12B is lower than the predetermined normal range, the results of the decisions at Step S109, S110, and S111 are YES and the process proceeds to Step S112.

At Step S112, the controller 8 decides whether or not the usage of the compressed air by a user has increased. Specifically, the controller 8 stores in advance information about the statistics about the usage of the compressed air by the user, schedule of the user, and the like, and, on the basis of the information, calculates and sets a threshold lower than the lower limit value of the predetermined normal range related to the sensed pressure P2 of the pressure sensor 12B. Then, if the sensed pressure P2 of the pressure sensor 12B is lower than the lower limit value of the predetermined normal range, and is equal to or higher than the threshold, it is decided that the usage of the compressed air by the user has increased. In contrast, if the sensed pressure P2 of the pressure sensor 12B is lower than the threshold, it is decided that the usage of the compressed air by the user has not increased, and the process proceeds to Step S113. At Step S113, the controller 8 estimates, as the cause of the anomaly, leakage of the compressed air on the downstream side of the high-pressure-stage compressor body 6, and outputs, to the display device 9, a command to perform a notification about the probable cause. The display device 9 displays a message, "Leakage of compressed air on downstream side of high-pressure-stage compressor body," for example, in response to the command.

The reason why the controller 8 can estimate, based on the decision results mentioned above, leakage of the compressed air on the downstream side of the high-pressure-stage compressor body 6 is explained. When the temperatures T1, T2, and T3, and the pressure P1 are normal values, it is conceivable that clogging of the intake air filter 4 has not occurred, and leakage of the compressed air on the upstream side of, on the inside, or on the downstream side of the intercooler 5 has not occurred also. Then, if the pressure P2 is a small value, it is anticipated that the usage of the compressed air by the user has increased or the compressed air is leaking on the downstream side of the high-pressure-stage compressor body 6. Then, if the usage of the compressed air by the user has not increased, it is conceivable that leakage of the compressed air on the downstream side of the high-pressure-stage compressor body 6 has occurred.

Note that the controller 8 may proceed to Step S113 without making the decision at Step S112 mentioned above, that is, without making decision as to whether or not the usage of the compressed air by the user has increased. In this case, at Step S113, the controller 8 estimates, as the cause of the anomaly, leakage of the compressed air on the downstream side of the high-pressure-stage compressor body 6 or an increase in usage of the compressed air, and outputs, to the display device 9, a command to perform a notification about the probable cause. The display device 9 displays a message, "Leakage of compressed air on downstream side of high-pressure-stage compressor body or increase in usage of compressed air," for example, in response to the command.

The controller 8 returns to Step S101 immediately or after a lapse of a predetermined length of time after estimating the cause of the anomaly and causing the display device 9 to perform a notification at Step S105, S107, or S113, and continues making decisions as to whether or not an anomaly has occurred in the sensed value of the sensor. Note that the controller 8 may be set not to cause the display device 9 to perform a notification again until after a lapse of a predetermined length of time if the controller 8 estimates the same cause of the anomaly as the previous one. In addition, if the controller 8 cannot estimate a cause of the anomaly (i.e. when Step S106, S108 or S113 is not reached) although the controller 8 decides that an anomaly has occurred in the sensed value of the sensor, the controller 8 may cause the display device 9 to perform a notification of the anomaly of the sensed value of the sensor. Specifically, if the result of the decision at Step S101 is NO or in other cases, for example, the process may proceed to Step S114. At Step S114, the controller 8 outputs, to the display device 9, a command to perform a notification of the anomaly of the sensed value of the sensor. The display device 9 displays the anomaly of the sensed value of the sensor in response to the command.

Figure 4:
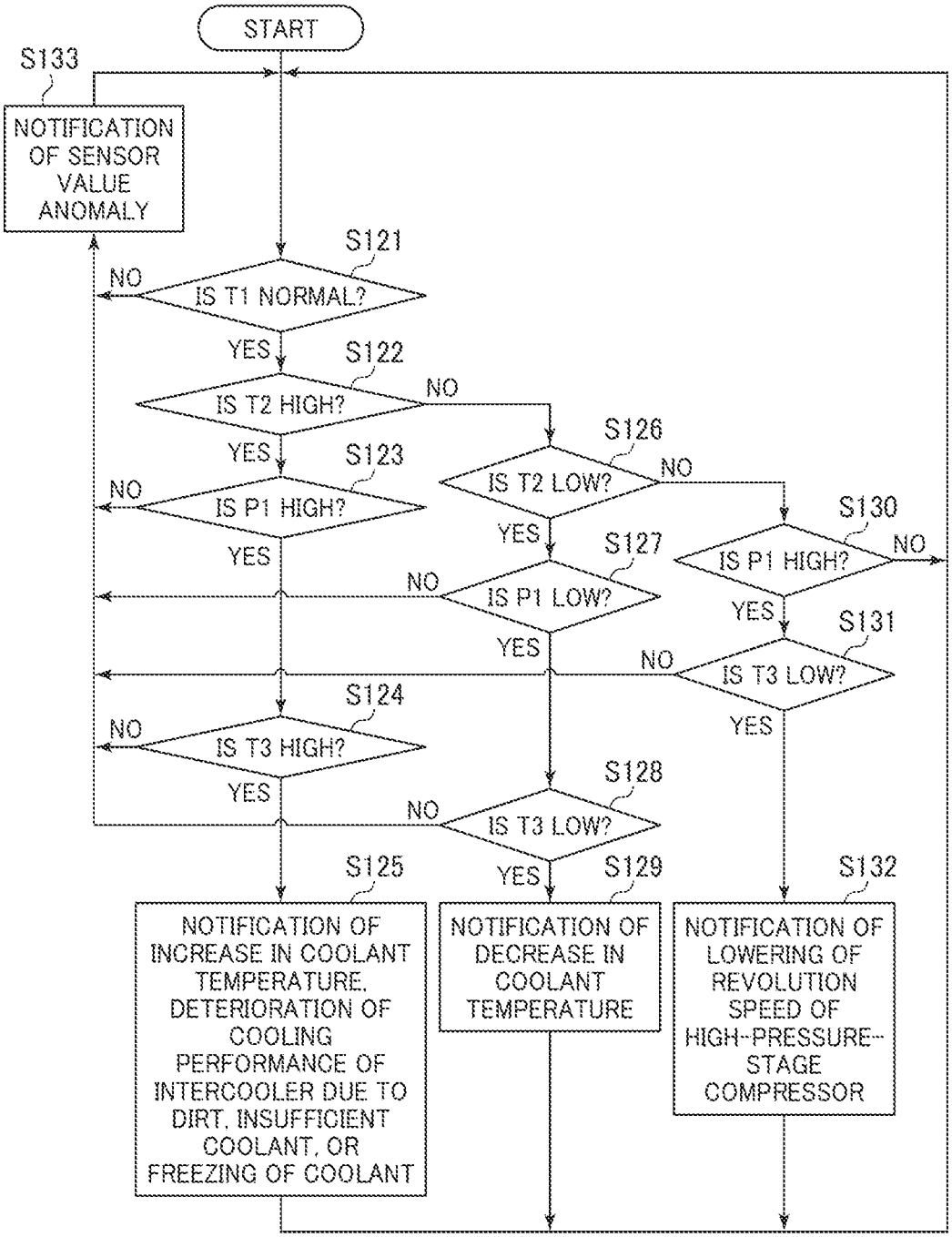
FIG. 4 is a flowchart representing a specific example of an estimating procedure of increase or decrease in coolant temperature, and lowering of a revolution speed of a high-pressure-stage compressor body performed by the controller according to the one embodiment of the present invention.

Next, an estimating procedure of increase or decrease in coolant temperature, and lowering of the revolution speed of the high-pressure-stage compressor body 6 performed by the controller 8 according to the present embodiment is explained by using FIG. 4. FIG. 4 is a flowchart representing a specific example of the estimating procedure of increase or decrease in coolant temperature, and lowering of the revolution speed of the high-pressure-stage compressor body 6 performed by the controller 8 according to the present embodiment. Note that it is needless to say that, for the controller 8, the order of Steps S121 to S124, S126 to S128, S130 and S131 mentioned below may be changed, or the controller 8 may perform estimation in such a manner as to compare a combination of decision results about the sensed values of the sensors with the table illustrated in FIG. 2, for example.

The controller 8 decides that the results at Steps S121 and S122 are YES and proceeds to Step S123 when the sensed temperature T1 of the temperature sensor 11A is within the predetermined normal range, and the sensed temperature T2 of the temperature sensor 11B is higher than the predetermined normal range. Furthermore, when the sensed pressure P1 of the pressure sensor 12A is higher than the predetermined normal range, and the sensed temperature T3 of the temperature sensor 11C is higher than the predetermined normal range, the results of the decisions at Steps S123 and S124 are YES and the process proceeds to Step S125. At Step S125, the controller 8 estimates, as the cause of the anomaly, increase in temperature of the coolant supplied to the intercooler 5, deterioration of the cooling performance of the intercooler 5 due to dirt, insufficiency of the coolant, or freezing of the coolant, and outputs, to the display device 9, a command to perform a notification about the probable cause. The display device 9 displays a message, "Increase in coolant temperature, deterioration of cooling performance of intercooler due to dirt, insufficiency of coolant, or freezing of coolant," for example, in response to the command.

The reason why the controller 8 can estimate, based on the decision results mentioned above, as the cause of the anomaly, increase in temperature of the coolant supplied to the intercooler 5, deterioration of the cooling performance of the intercooler 5 due to dirt, insufficiency of the coolant, or freezing of the coolant is explained. All of increase in coolant temperature, deterioration of the cooling performance the intercooler 5 due to dirt, insufficiency of the coolant, and freezing of the coolant imply insufficient cooling of the intercooler 5. Accordingly, despite the fact that the temperature T1 of the compressed air on the upstream side of the intercooler 5 is a normal value, the temperature T2 of the compressed air on the downstream side of the intercooler 5 is a large value. Since the volume of the line from the low-pressure-stage compressor body 3 to the high-pressure-stage compressor body 6 is constant, an increase in the temperature T2 leads also to an increase in the pressure P1. In addition, since the temperature T2 of air taken into the high-pressure-stage compressor body 6 is high, the temperature T3 of the compressed air discharged from the high-pressure-stage compressor body 6 also is a large value.

The controller 8 decides that the result at Step S121 is YES and proceeds to Step S122 when the sensed temperature T1 of the temperature sensor 11A is within the predetermined normal range. Furthermore, when the sensed temperature T2 of the temperature sensor 11B is lower than the predetermined normal range, the result of the decision at Step S122 is NO, the process proceeds to Step S126, the result of the decision at Step S126 is YES, and the process proceeds to Step S127. Furthermore, when the sensed pressure P1 of the pressure sensor 12A is lower than the predetermined normal range, and the sensed temperature T3 of the temperature sensor 11C is lower than the predetermined normal range, the results of the decisions at Steps S127 and S128 are YES and the process proceeds to Step S129. At Step S129, the controller 8 estimates, as the cause of the anomaly, a temperature decrease in the coolant supplied to the intercooler 5, and outputs, to the display device 9, a command to perform a notification about the probable cause. The display device 9 displays a message, "Decrease in coolant temperature," for example, in response to the command.

The reason why the controller 8 can estimate, based on the decision results mentioned above, as the cause of the anomaly, decrease in temperature of the coolant supplied to the intercooler 5 is explained. A decrease in coolant temperature implies excessive cooling of the intercooler 5. Accordingly, despite the fact that the temperature T1 of the compressed air on the upstream side of the intercooler 5 is a normal value, the temperature T2 of the compressed air on the downstream side of the intercooler 5 is a small value. Since the volume of the line from the low-pressure-stage compressor body 3 to the high-pressure-stage compressor body 6 is constant, a decrease in the temperature T2 leads also to a decrease in the pressure P1. In addition, since the temperature T2 of air taken into the high-pressure-stage compressor body 6 is low, the temperature T3 of the compressed air discharged from the high-pressure-stage compressor body 6 also is a small value.

The controller 8 decides that the result at Step S121 is YES and proceeds to Step S122 when the sensed temperature T1 of the temperature sensor 11A is within the predetermined normal range. Furthermore, when the sensed temperature T2 of the temperature sensor 11B is within the predetermined normal range, the results of the decisions at Steps S122 and S126 are NO and the process proceeds to Step S130. Furthermore, when the sensed pressure P1 of the pressure sensor 12A is higher than the predetermined normal range, and the sensed temperature T3 of the temperature sensor 11C is lower than the predetermined normal range, the results of the decisions at Steps S130 and S131 are YES and the process proceeds to Step S132. At Step S132, the controller 8 estimates, as the cause of the anomaly, lowering of revolution speed of the high-pressure-stage compressor body 6 below the predetermined normal range, and outputs, to the display device 9, a command to perform a notification about the probable cause. The display device 9 displays a message, "Lowering of revolution speed of high-pressure-stage compressor body," for example, in response to the command.

The reason why the controller 8 can estimate, based on the decision results mentioned above, as the cause of the anomaly, lowering of the revolution speed of the high-pressure-stage compressor body 6 is explained. If the revolution speed of the high-pressure-stage compressor body 6 has lowered despite the fact the low-pressure-stage compressor body 3 is operating normally, the amount of air to be taken by the high-pressure-stage compressor body 6 decreases, and thus the volume of air in the line from the low-pressure-stage compressor body 3 to the high-pressure-stage compressor body 6 increases. Since the volume of the line from the low-pressure-stage compressor body 3 to the high-pressure-stage compressor body 6 is constant, the pressure P1 increases along with an increase in the air volume if the temperature T1 remains constant. Since the temperature T2 is influenced less by the increase in the air volume in this case, it stays in the normal range. In addition, when the revolution speed of the high-pressure-stage compressor body 6 has lowered, the amount of air leaking from compression chambers increases, and the compression efficiency deteriorates. Thereby, the pressure P2 and the temperature T3 lower.

The controller 8 returns to Step S121 immediately or after a lapse of a predetermined length of time and continues making decisions as to whether or not an anomaly has occurred in the sensed value of the sensor after estimating the cause of the anomaly and causing the display device 9 to perform a notification at Step S125, S129, or S132. Note that the controller 8 may be set not to cause the display device 9 to perform a notification again until after a lapse of a predetermined length of time if the controller 8 estimates the same cause of the anomaly as the previous one. In addition, if the controller 8 cannot estimate a cause of the anomaly (i.e. when Step S125, S129 or S132 is not reached) although the controller 8 decides that an anomaly has occurred in the sensed value of the sensor, the controller 8 may cause the display device 9 to perform a notification of the anomaly of the sensed value of the sensor. Specifically, when the result of the decision at Step S121 is NO or in other cases, for example, the process may proceed to Step S133. At Step S133, the controller 8 outputs, to the display device 9, a command to perform a notification of the anomaly of the sensed value of the sensor. The display device 9 displays the anomaly of the sensed value of the sensor in response to the command.

As mentioned above, in the present embodiment, a cause of an anomaly can be specified when the anomaly has occurred in a sensed value of any of the sensors 11A, 11B, 11C, 12A, and 12B. In addition, since it is not necessary to add a sensor to sense the temperature of the coolant or the revolution speed of the high-pressure-stage compressor body 6, for example, for the purpose of specifying the cause of the anomaly, it is possible to reduce the costs.

Advantages of the present embodiment are additionally explained. Not only when leakage of the compressed air on the upstream side of the intercooler 5 or clogging of the intake air filter 4 has occurred, but also when leakage of the compressed air on the inside or on the downstream side of the intercooler 5 has occurred, the sensed pressure P1 of the pressure sensor 12A becomes lower than the predetermined normal range and the sensed temperature T3 of the temperature sensor 11C becomes higher than the predetermined normal range. In view of this, in the present embodiment, in addition to the conditions mentioned before, if the sensed temperature T2 of the temperature sensor 11B is lower than the predetermined normal range, it is estimated that the cause of the anomaly is leakage of the compressed air on the upstream side of the intercooler 5 or clogging of the intake air filter 4, and in addition to the conditions mentioned before, if the sensed temperature T2 of the temperature sensor 11B is within the predetermined normal range, it is estimated that the cause of the anomaly is leakage of the compressed air on the inside or on the downstream side of the intercooler 5. Accordingly, the cause of the anomaly can be identified.

In addition, not only when leakage of the compressed air on the upstream side of the intercooler 5 or clogging of the intake air filter 4 has occurred, but also when a decrease in temperature of the coolant supplied to the intercooler 5 has occurred, the sensed pressure P1 of the pressure sensor 12A becomes lower than the predetermined normal range and the sensed temperature T2 of the temperature sensor 11B becomes lower than the predetermined normal range. In view of this, in the present embodiment, in addition to the conditions mentioned before, if the sensed temperature T3 of the temperature sensor 11C is higher than the predetermined normal range, it is estimated that the cause of the anomaly is leakage of the compressed air on the upstream side of the intercooler 5 or clogging of the intake air filter 4, and in addition to the conditions mentioned before, if the sensed temperature T3 of the temperature sensor 11C is lower than the predetermined normal range, it is estimated that the cause of the anomaly is a decrease in coolant temperature. Accordingly, the cause of the anomaly can be identified.

In addition, not only when leakage of the compressed air on the downstream side of the high-pressure-stage compressor body 6 or an increase in usage of the compressed air has occurred, but also when lowering of the revolution speed of the high-pressure-stage compressor body 6 has occurred, the sensed temperature T2 of the temperature sensor 11B is within the predetermined normal range and the sensed pressure P2 of the pressure sensor 12B becomes lower than the predetermined normal range. In view of this, in the present embodiment, in addition to the conditions mentioned before, if the sensed pressure P1 of the pressure sensor 12A is within the predetermined normal range, and the sensed temperature T3 of the temperature sensor 11C is within the predetermined normal range, it is estimated that the cause of the anomaly is leakage of the compressed air on the downstream side of the high-pressure-stage compressor body 6, and in addition to the conditions mentioned before, if the sensed pressure P1 of the pressure sensor 12A is higher than the predetermined normal range, and the sensed temperature T3 of the temperature sensor 11C is lower than the predetermined normal range, it is estimated that the cause of the anomaly is lowering of the revolution speed of the high-pressure-stage compressor body 6. Accordingly, the cause of the anomaly can be identified.

Note that although a particular explanation is not given in the one embodiment described above, the controller 8 may change the predetermined normal range about the sensed value of each sensor according to the running state and installation environment of the compressor, user setting, and the like. Immediately after the running state of the compressor switches between load running and no-load running, the temperature and pressure in the compressor are different from those in the steady state. Accordingly, when the predetermined normal ranges are changed according to the running state of the compressor, the notifications mentioned above may not be performed for a predetermined length of time. Similarly, also when the predetermined normal ranges are changed due to other reasons also, the notifications mentioned above may not be performed for a predetermined length of time.

In addition, although a particular explanation is not given in the one embodiment described above, the controller 8 may stop the electric motor 2 as necessary when it is decided that an anomaly has occurred in the sensed value of the sensor. That is, the electric motor 2 may be stopped when the sensed value of the sensor reach a predetermined threshold set to or higher than the upper limit value of the predetermined normal range. In addition, the electric motor 2 may be stopped when the sensed value of the sensor reach a predetermined threshold set to or lower than the lower limit value of the predetermined normal range.

Figure 5:
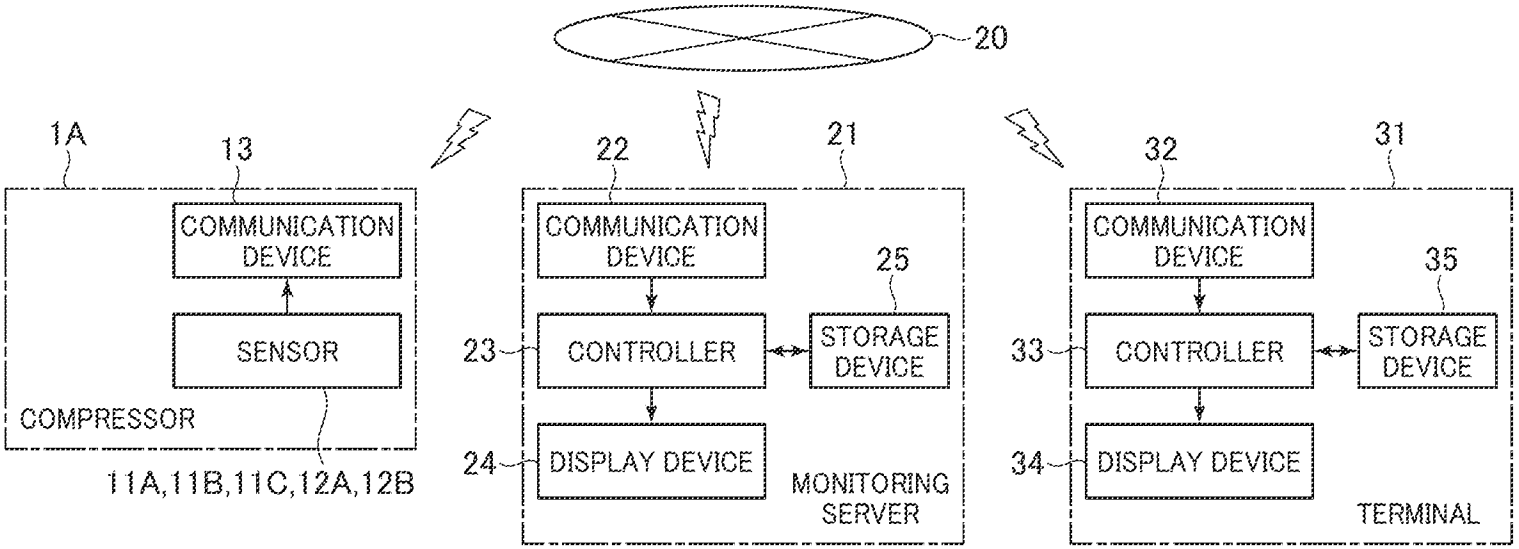
FIG. 5 is a schematic diagram representing a configuration of a monitoring system according to another embodiment of the present invention.

A monitoring system according to another embodiment of the present invention is explained by using FIG. 5. Note that portions in the present embodiment that are equivalent to those in the one embodiment described above are given the same reference character, and explanations thereof are omitted as appropriate.

FIG. 5 is a schematic diagram representing the configuration of the monitoring system according to the present embodiment.

The monitoring system according to the present embodiment includes a compressor 1A, a monitoring server 21 that monitors the compressor 1A, and a terminal 31 that receives information transmitted from the monitoring server 21.

Although not illustrated in FIG. 5, similarly to the compressor 1 mentioned above, the compressor 1A includes the electric motor 2, the low-pressure-stage compressor body 3, the intake air filter 4, the intercooler 5, the high-pressure-stage compressor body 6, the aftercooler 7, the controller 8, the display device 9, the coolant line 10, the temperature sensors 11A, 11B, and 11C, and the pressure sensors 12A and 12B. Note that the controller 8 according to the present embodiment may not have the function of estimating a cause of an anomaly. As illustrated in FIG. 5, the compressor 1A includes a communication device 13 that transmits sensing results of the temperature sensors 11A, 11B, and 11C and the pressure sensors 12A and 12B.

The monitoring server 21 includes: a communication device 22 that receives sensing results of the temperature sensors 11A, 11B, and 11C and the pressure sensors 12A and 12B via a communication network 20 (specifically, a wide area network such as the Internet, and a small area network such as a LAN, for example); a controller 23, a display device 24; and a storage device 25. Similarly to the controller 8, the controller 23 has a calculation control section (e.g. a CPU), a storage section (e.g. a ROM and a RAM), and the like. In addition, similarly to the controller 8 according to the one embodiment described above, the controller 23 decides whether or not an anomaly has occurred in the sensed temperature T1 of the temperature sensor 11A, the sensed pressure P1 of the pressure sensor 12A, the sensed temperature T2 of the temperature sensor 11B, the sensed temperature T3 of the temperature sensor 11C, and the sensed pressure P2 of the pressure sensor 12B, and estimates a cause of the anomaly. Then, the controller 23 causes the display device 24 to display the probable cause of the anomaly. The storage device 25 is configured to store, in time series, sensing results of the temperature sensors 11A, 11B, and 11C and the pressure sensors 12A and 12B that are received by the communication device 22, and store the cause of the anomaly estimated by the controller 23.

The communication device 22 of the monitoring server 21 transmits the cause of the anomaly estimated by the controller 23 along with sensing results of the temperature sensors 11A, 11B, and 11C and the pressure sensors 12A and 12B, and the like. The terminal 31 includes: a communication device 32 that receives information transmitted from the monitoring server 21 via the communication network 20; a controller 33; a display device 34; and a storage device 35. Similarly to the controller 8, the controller 33 has a calculation control section (e.g. a CPU), a storage section (e.g. a ROM and a RAM), and the like. In addition, the controller 33 processes the cause of the anomaly and the sensing results of the temperature sensors 11A, 11B, and 11C and the pressure sensors 12A and 12B received by the communication device 32, and the like, and causes the display device 34 to display them. The storage device 35 is configured to store, in time series, the cause of the anomaly and the sensing results of the temperature sensors 11A, 11B, and 11C and the pressure sensors 12A and 12B that are received by the communication device 32.

In the thus-configured present embodiment also, similarly to the one embodiment described above, a cause of an anomaly can be specified when the anomaly has occurred in the sensed value of any of the sensors 11A, 11B, 11C, 12A, and 12B.

Note that although notification devices performing a notification of a cause of an anomaly are the display devices 9, 24, or 34 that display the cause of the anomaly in the examples explained in the embodiments described above, these are not the sole examples, and modifications are possible within the scope not deviating from the gist and technical idea of the present invention. A sound output device that outputs a cause of an anomaly with sound may be used as a notification device, for example.

In addition, although the controller 8 or 23 estimates, as a cause of an anomaly, leakage of the compressed air on the upstream side of the intercooler 5 or clogging of the intake air filter 4, leakage of the compressed air on the inside or on the downstream side of the intercooler 5, leakage of the compressed air on the downstream side of the high-pressure-stage compressor body 6 or an increase in usage of the compressed air, insufficient cooling of the intercooler 5, excessive cooling of the intercooler 5, or lowering of the revolution speed of the high-pressure-stage compressor body 6 in the examples explained in the embodiments described above, these are not the sole examples, and modifications are possible within the scope not deviating from the gist and technical idea of the present invention. That is, the controller 8 or 23 may estimate any one of leakage of the compressed air on the upstream side of the intercooler 5 or clogging of the intake air filter 4, leakage of the compressed air on the inside or on the downstream side of the intercooler 5, leakage of the compressed air on the downstream side of the high-pressure-stage compressor body 6 or an increase in usage of the compressed air, insufficient cooling of the intercooler 5, excessive cooling of the intercooler 5, and lowering of the revolution speed of the high-pressure-stage compressor body 6. If the controller 8 or 23 does not estimate leakage of the compressed air on the downstream side of the high-pressure-stage compressor body 6, the pressure sensor 12B may not be provided in the compressor 1 or 1A.

In addition, although the intercooler 5 and the aftercooler 7 cool the compressed air by using the coolant supplied via the coolant line 10 in the examples explained in the embodiments described above, these are not the sole examples, and modifications are possible within the scope not deviating from the gist and technical idea of the present invention. The intercooler and the aftercooler may cool the compressed air by using cooling air induced by a cooling fan, for example. In such modification examples, the controller 8 or 23 may estimate, as a cause of an anomaly, increase or decrease in temperature of the cooling air (cooling medium) supplied to the intercooler, or the like.

In addition, although the compressor body 3 or 6 is a screw rotor type compressor body, and includes a pair of female and male screw rotors in the examples explained in the embodiments described above, these are not the sole examples, and modifications are possible within the scope not deviating from the gist and technical idea of the present invention. The compressor body 3 or 6 may include one screw rotor or three or more screw rotors, for example. In addition, the compressor body 3 or 6 may be a scroll type compressor body, for example. In addition, the compressor body 3 or 6 may be one that compresses a gas other than air.

DESCRIPTION OF REFERENCE CHARACTERS

1, 1A: Compressor

3: Low-pressure-stage compressor body

4: Intake air filter
5: Intercooler
6: High-pressure-stage compressor body
8: Controller
9: Display device (notification device)
10: Coolant line
11A: Temperature sensor (first temperature sensor)
11B: Temperature sensor (second temperature sensor)
11C: Temperature sensor (third temperature sensor)
12A: Pressure sensor (first pressure sensor)
12B: Pressure sensor (second pressure sensor)
13: Communication device
21: Monitoring server
22: Communication device
23: Controller
24: Display device (notification device)
31: Terminal
34: Display device (notification device)

The invention claimed is:

1. A compressor including a low-pressure-stage compressor body that compresses a gas, an intercooler that uses a cooling medium to cool the compressed gas discharged from the low-pressure-stage compressor body, and a high-pressure-stage compressor body that further compresses the compressed gas having been cooled by the intercooler, the compressor comprising:

a first temperature sensor that senses a temperature of the compressed gas on a discharge side of the low-pressure-stage compressor body and on an upstream side of the intercooler;

a first pressure sensor that senses a pressure of the compressed gas on the discharge side of the low-pressure-stage compressor body;

a second temperature sensor that senses a temperature of the compressed gas on an intake side of the high-pressure-stage compressor body and on a downstream side of the intercooler;

a third temperature sensor that senses a temperature of the compressed gas on a discharge side of the high-pressure-stage compressor body;

a controller configured to store predetermined normal ranges respectively corresponding to sensed values that consist of a sensed temperature of the first temperature sensor, a sensed pressure of the first pressure sensor, a sensed temperature of the second temperature sensor, and a sensed temperature of the third temperature sensor, determine whether or not each of the sensed values is within the corresponding normal range, and estimate a cause of an anomaly, when one of the sensed values is determined to be not within the corresponding normal range, based on a determination result of the one and the determination results of whether or not remains of the sensed values are within the corresponding normal ranges;

a notification device that performs a notification of the cause of the anomaly estimated by the controller; and wherein the controller estimates, as the cause of the anomaly, lowering of a revolution speed of the high-pressure-stage compressor body below a predetermined normal range when the sensed temperature of the first temperature sensor is within a predetermined normal range, the sensed pressure of the first pressure sensor is higher than a predetermined normal range, the sensed temperature of the second temperature sensor is within a predetermined normal range, and the sensed temperature of the third temperature sensor is lower than a predetermined normal range.

2. The compressor according to claim 1, wherein the controller estimates, as the cause of the anomaly, leakage of the compressed gas on the upstream side of the intercooler or clogging of an intake air filter provided on an intake side of the low-pressure-stage compressor body when the sensed temperature of the first temperature sensor is within a predetermined normal range, the sensed pressure of the first pressure sensor is lower than a predetermined normal range, the sensed temperature of the second temperature sensor is lower than a predetermined normal range, and the sensed temperature of the third temperature sensor is higher than a predetermined normal range.

3. The compressor according to claim 1, wherein the controller estimates, as the cause of the anomaly, leakage of the compressed gas on an inside or on the downstream side of the intercooler when the sensed temperature of the first temperature sensor is within a predetermined normal range, the sensed pressure of the first pressure sensor is lower than a predetermined normal range, the sensed temperature of the second temperature sensor is within a predetermined normal range, and the sensed temperature of the third temperature sensor is higher than a predetermined normal range.

4. The compressor according to claim 1, further comprising:

a second pressure sensor that senses a pressure of the compressed gas on the discharge side of the high-pressure-stage compressor body, wherein the controller further decides whether or not an anomaly has occurred in a sensed pressure of the second pressure sensor, and estimates, as the cause of the anomaly, leakage of the compressed gas on a downstream side of the high-pressure-stage compressor body or an increase in usage of the compressed gas when the sensed temperature of the first temperature sensor is within a predetermined normal range, the sensed pressure of the first pressure sensor is within a predetermined normal range, the sensed temperature of the second temperature sensor is within a predetermined normal range, the sensed temperature of the third temperature sensor is within a predetermined normal range, and the sensed pressure of the second pressure sensor is lower than a predetermined normal range.

5. The compressor according to claim 1, wherein the controller estimates, as the cause of the anomaly, insufficient cooling of the intercooler when the sensed temperature of the first temperature sensor is within a predetermined normal range, the sensed pressure of the first pressure sensor is higher than a predetermined normal range, the sensed temperature of the second temperature sensor is higher than a predetermined normal range, and the sensed temperature of the third temperature sensor is higher than a predetermined normal range.

6. The compressor according to claim 1, wherein the controller estimates, as the cause of the anomaly, excessive cooling of the intercooler when the sensed temperature of the first temperature sensor is within a predetermined normal range, the sensed pressure of the first pressure sensor is lower than a predetermined normal range, the sensed temperature of the second temperature sensor is lower than a predetermined normal range, and the sensed temperature of the third temperature sensor is lower than a predetermined normal range.

7. A monitoring system comprising:

a compressor including a low-pressure-stage compressor body that compresses a gas, an intercooler that cools the compressed gas discharged from the low-pressure-stage compressor body, a high-pressure-stage compressor body that further compresses the compressed gas having been cooled by the intercooler, a first temperature sensor that senses a temperature of the compressed gas on a discharge side of the low-pressure-stage compressor body and on an upstream side of the intercooler, a first pressure sensor that senses a pressure of the compressed gas on the discharge side of the low-pressure-stage compressor body, a second temperature sensor that senses a temperature of the compressed gas on an intake side of the high-pressure-stage compressor body and on a downstream side of the intercooler, a third temperature sensor that senses a temperature of the compressed gas on a discharge side of the high-pressure-stage compressor body, and a communication device that transmits sensing results of the first temperature sensor, the first pressure sensor, the second temperature sensor, and the third temperature sensor;

a monitoring server including a communication device that receives the sensing results of the first temperature sensor, the first pressure sensor, the second temperature sensor, and the third temperature sensor, a controller configured to store predetermined normal ranges respectively corresponding to sensed values that consist of a sensed temperature of the first temperature sensor, a sensed pressure of the first pressure sensor, a sensed temperature of the second temperature sensor, and a sensed temperature of the third temperature sensor, determine whether or not each of the sensed values is within the corresponding normal range, and estimate a cause of an anomaly, when one of the sensed values is determined to be not within the corresponding normal range, based on a determination result of the one and the determination results of whether or not remains of the sensed values are within the corresponding normal ranges, and a notification device that performs a notification of the cause of the anomaly estimated by the controller; and wherein the controller of the monitoring server estimates, as the cause of the anomaly, lowering of a revolution speed of the high-pressure-stage compressor body below a predetermined normal range when the sensed temperature of the first temperature sensor is within a predetermined normal range, the sensed pressure of the first pressure sensor is higher than a predetermined normal range, the sensed temperature of the second temperature sensor is within a predetermined normal range, and the sensed temperature of the third temperature sensor is lower than a predetermined normal range.

8. The monitoring system according to claim 7, wherein the controller of the monitoring server estimates, as the cause of the anomaly, leakage of the compressed gas on the upstream side of the intercooler or clogging of an intake air filter provided on an intake side of the low-pressure-stage compressor body when the sensed temperature of the first temperature sensor is within a predetermined normal range, the sensed pressure of the first pressure sensor is lower than a predetermined normal range, the sensed temperature of the second temperature sensor is lower than a predetermined normal range, and the sensed temperature of the third temperature sensor is higher than a predetermined normal range.

9. The monitoring system according to claim 7, wherein the controller of the monitoring server estimates, as the cause of the anomaly, leakage of the compressed gas on an inside or on the downstream side of the intercooler when the sensed temperature of the first temperature sensor is within a predetermined normal range, the sensed pressure of the first pressure sensor is lower than a predetermined normal range, the sensed temperature of the second temperature sensor is within a predetermined normal range, and the sensed temperature of the third temperature sensor is higher than a predetermined normal range.

10. The monitoring system according to claim 7, wherein the compressor further includes a second pressure sensor that senses a pressure of the compressed gas on the discharge side of the high-pressure-stage compressor body, and the controller of the monitoring server further decides whether or not an anomaly has occurred in a sensed pressure of the second pressure sensor, and, estimates, as the cause of the anomaly, leakage of the compressed gas on a downstream side of the high-pressure-stage compressor body or an increase in usage of the compressed gas when the sensed temperature of the first temperature sensor is within a predetermined normal range, the sensed pressure of the first pressure sensor is within a predetermined normal range, the sensed temperature of the second temperature sensor is within a predetermined normal range, the sensed temperature of the third temperature sensor is within a predetermined normal range, and the sensed pressure of the second pressure sensor is lower than a predetermined normal range.

11. The monitoring system according to claim 7, wherein the controller of the monitoring server estimates, as the cause of the anomaly, insufficient cooling of the intercooler when the sensed temperature of the first temperature sensor is within a predetermined normal range, the sensed pressure of the first pressure sensor is higher than a predetermined normal range, the sensed temperature of the second temperature sensor is higher than a predetermined normal range, and the sensed temperature of the third temperature sensor is higher than a predetermined normal range.

12. The monitoring system according to claim 7, wherein the controller of the monitoring server estimates, as the cause of the anomaly, excessive cooling of the intercooler when the sensed temperature of the first temperature sensor is within a predetermined normal range, the sensed pressure of the first pressure sensor is lower than a predetermined normal range, the sensed temperature of the second temperature sensor is lower than a predetermined normal range, and the sensed temperature of the third temperature sensor is lower than a predetermined normal range.

13. The monitoring system according to claim 7, further comprising:

a terminal, wherein the terminal includes a communication device that receives, as information transmitted from the communication device of the monitoring server, the cause of the anomaly estimated by the controller of the monitoring server, and a notification device that performs a notification of the cause of the anomaly received by the communication device.

* * * * *